US008533910B2

(12) United States Patent
Bennett et al.

(10) Patent No.: US 8,533,910 B2
(45) Date of Patent: Sep. 17, 2013

(54) BENDABLE TRACK AND FLEXIBLE CARRIER FOR CURTAINS

(75) Inventors: Matthew G. Bennett, New Berlin, WI (US); Roger W. Lehrkamp, Milwaukee, WI (US)

(73) Assignee: In Pro Corporation, Muskego, WI (US)

( * ) Notice: Subject to any disclaimer, the term of this patent is extended or adjusted under 35 U.S.C. 154(b) by 156 days.

(21) Appl. No.: 13/073,126

(22) Filed: Mar. 28, 2011

(65) Prior Publication Data

US 2012/0246872 A1 Oct. 4, 2012

(51) Int. Cl.
*A47H 13/00* (2006.01)

(52) U.S. Cl.
USPC ..... 16/87.8; 16/96 R

(58) Field of Classification Search
USPC ..... 16/87.4 R, 87.6 R, 87.8, 93 R, 93 D, 16/94 R, 94 D, 95 R, 95 D, 96 R, 96 D; 160/345, 346, 330
See application file for complete search history.

(56) References Cited

U.S. PATENT DOCUMENTS

| | | | | | |
|---|---|---|---|---|---|
| 2,317,531 | A | * | 4/1943 | Hudson et al. | 206/326 |
| 2,405,020 | A | * | 7/1946 | Dierking | 16/87.8 |
| 2,528,848 | A | * | 11/1950 | Weinzimmer | 16/87.6 R |
| 2,597,224 | A | * | 5/1952 | Charron et al. | 16/87.6 R |
| 4,014,071 | A | * | 3/1977 | Janson | 16/93 R |
| 4,102,008 | A | | 7/1978 | Janson | |
| 4,134,177 | A | * | 1/1979 | Janson | 16/96 D |
| 4,306,332 | A | | 12/1981 | Simmons | |
| 4,336,757 | A | | 6/1982 | Toder | |
| 4,524,698 | A | * | 6/1985 | Tourtellier et al. | 104/107 |
| 4,694,531 | A | * | 9/1987 | Foy | 16/87.4 R |
| 4,793,399 | A | * | 12/1988 | Pryor | 160/345 |
| 4,796,684 | A | * | 1/1989 | Haimovitz | 160/330 |
| 5,116,056 | A | | 5/1992 | Schmutte | |
| D337,493 | S | | 7/1993 | King | |
| 5,335,890 | A | | 8/1994 | Pryor et al. | |
| 5,421,059 | A | * | 6/1995 | Leffers, Jr. | 16/87.4 R |
| 5,509,713 | A | | 4/1996 | Hou | |

(Continued)

OTHER PUBLICATIONS

Product Cut Sheet: I-Series Cubicle Curtain Track System. Product Sheet [online]. Mariak Contract [retrieved on Mar. 14, 2011]. Retrieved from the Internet: <URL: http://www.mariak.com/images/pdf/cubicle_curtain/CT%20Spec%20Cut%20Sheet%20I-Series.pdf>.

(Continued)

*Primary Examiner* — William Miller
(74) *Attorney, Agent, or Firm* — Lawrence S Pope

(57) ABSTRACT

The present application discloses means for vertically mounting curtains for easy traverse utilizing an easily mountable bendable track for providing an adjustable path for traverse and flexible carriers which are readily affixable to the bendable track at any point in its length and traverse the bendable track under the load of a supported curtain with a minimum of noise. It discloses a bendable track with both a top and a bottom rib, each of which has a horizontal ledge and a curved profile extending from each ledge away from the main body of the rail and a roller free carrier which can be elastically expanded to snap over the lower horizontal ledge of the track. It further discloses that the surface of the horizontal ledge as well as the ends of the carrier are made of materials having a low coefficient of sliding friction such as exhibited by ABS, nylon, PVC and polyacetal and that the ends of the carrier have a surface with an arcuate surface which is adapted to ride on the lower horizontal ledge.

14 Claims, 3 Drawing Sheets

(56) References Cited

U.S. PATENT DOCUMENTS

| | | | | |
|---|---|---|---|---|
| 6,173,753 | B1 | 1/2001 | Laster-Bivens et al. | |
| 6,409,415 | B1 | 6/2002 | Toder | |
| 7,653,966 | B2 | 2/2010 | Quinn et al. | |
| 7,735,189 | B2 * | 6/2010 | Richardson | 16/87.2 |
| D661,533 | S * | 6/2012 | Bennett et al. | D6/580 |
| 8,240,354 | B2 * | 8/2012 | Coleman et al. | 160/188 |
| 2007/0277944 | A1 | 12/2007 | Wu | |
| 2011/0061819 | A1 | 3/2011 | Elinson | |

OTHER PUBLICATIONS

Cubicle Curtain Tracks. Online Catalog [online]. Mariak Contract [retrieved on Mar. 14, 2011]. Retrieved from the Internet: <URL:http://www.mariak.com/index.php?option=com_content&view=article&id=53>.

Bendable Track. Online Catalog [online]. Konnect International [retrieved on Mar. 14, 2011]. Retrieved from the Internet: <URL:http://www.konnectinternational.com/app/stx.products.asp?cid=1>.

T-Bar Application. Online Catalog [online]. Konnect International [retrieved on Mar. 14, 2011]. Retrieved from the Internet: <URL: http://www.konnectinternational.com/app/stx.products.asp?cid=16 >.

Roller. Online Catalog [online]. Konnect International [retrieved on Mar. 14, 2011]. Retrieved from the Internet: <URL: http://www.konnectinternational.com/app/stx.products.asp?cid=2 >.

Ceiling Mount Cartridge. Online Catalog [online]. Konnect International [retrieved on Mar. 14, 2011]. Retrieved from the Internet: <URL:http://www.konnectinternational.com/app/stx.products.asp?cid=4>.

Assembly Photo. Online Catalog [online]. Konnect International [retrieved on Mar. 14, 2011]. Retrieved from the Internet: <URL: http://www. konnectinternational.com/app/stx.products.asp?cid=19>.

Aluglide Bendable Track. Online Catalog [online]. Tracks & poles & things [retrieved on Mar. 14, 2011]. Retrieved from the Internet: <URL:http://www.tracksandpoles.com/track_set.shtml#>.

Nylon Wheel Carrier With Brass Ring. Online Catalog [online]. Sailbrite [retrieved on Mar. 14, 2011]. Retrieved from the Internet: <URL:http://www.sailrite.com/RECMAR-4121-Nylon-Wheel-Carrier-With-Brass-Ring-Pk14>.

Nylon Block Carrier. Online Catalog [online]. Sailbrite [retrieved on Mar. 14, 2011]. Retrieved from the Internet: <URL: http://www.sailrite.com/RECMAR-3312-Nylon-Block-Carrier>.

Bendable I Beam Curtain Track Aluminum 48" Long. Online Catalog [online]. Sailbrite [retrieved on Mar. 14, 2011]. Retrieved from the Internet: <URL:http://www.sailrite.com/RECMAR-4108-Bendable-I-Beam-Curtain-Track-Aluminum-48-Long>.

Office Action of May 13, 2008 in U.S. Appl. No. 11/442,973.

Bendable Track Heavy Duty T1. Archived Copy from Oct. 16, 2008 of Online Catalog [online]. Konnect International [retrieved on Apr. 9, 2011]. Retrieved from the Internet: <URL:http://web.archive.org/web/20081016075741/http://www.konnectinternational.com/app/stx.products.asp?cid=1>.

* cited by examiner

BENDABLE TRACK AND FLEXIBLE CARRIER FOR CURTAINS

BACKGROUND OF THE INVENTION

Combinations of tracks and carriers are known to the art for vertically suspending curtains in a manner such that the curtains can be slid open or closed along a non-linear path by pulling on the curtain. Among these are those which involve ceiling mounted tracks and curtains used to create temporarily enclosed spaces such as the cubicle curtains common in hospitals. In some of these known systems the track is flexible such that a continuous length of track can bend to follow a non-linear path incorporating curves and bends. Although it is typical that the carriers are loaded onto the track by being slid over one of the ends, there is a development in which a carrier can be expanded so that it can be added mid-track by pulling the two open ends apart. However, the known tracks are typically in the shape of I-beams with rectangular bottom and top portions and the known carriers typically feature wheels which ride on top of the lower rectangular portion of the I-beam.

However, there is a need for a carrier and track system in which the carriers can be more readily suspended from the track and traverse the track with less noise and a need for tracks which can be more readily affixed to a ceiling or other supporting structure. A system which allowed the carriers to be single handedly mounted mid-track and allowed the track to be mounted in support devices affixed to the ceiling by simply pushing the track against these devices would be a significant advance. The present invention provides such a system.

SUMMARY OF THE INVENTION

The present invention is concerned with a means for vertically mounting curtains for easy traverse utilizing an easily mountable bendable track for providing an adjustable path for traverse and flexible carriers which are readily affixable to the bendable track at any point in its length and traverse the bendable track under the load of a supported curtain with a minimum of noise. The bendable track is conveniently a main body which carries ribs or projections on its upper and lower edges to facilitate mounting it to a ceiling and affixing flexible carriers to it, respectively. The flexible carriers are generally C shaped articles which can be snap fitted on the lower rib of the bendable track such that they can easily ride on the lower rib of the bendable track with a minimum of sliding friction without the use of rollers or wheels and which carry a means for connecting to a curtain on the backbone of the C.

The bendable track has a main body which has a vertical axis which is substantially greater in length than its horizontal axis and has a rib projecting horizontally from both sides of the main body at both its upper edge and its lower edge with at least the rib the lower edge providing a horizontal surface on each side of the main body. This horizontal surface has a relatively low coefficient of sliding friction such that it can be mated with a roller free flexible carrier to provide no more friction to sliding motion than would be observed with a carrier mounted via wheels. This track is capable of being bent in the horizontal direction to suffer plastic deformation, i.e. to take a permanent set, by a normal adult human without the use of tools, preferably a plastic deformation or set of at least about 90°, but strongly resists being bent in the vertical direction. Preferably the width of the track beneath the horizontal ledge formed by the lower rib gradually decreases in width in proceeding vertically away from the main body of the track. More preferably the track has an arcuate surface beneath said horizontal ledge. In a particularly preferred embodiment the bendable track is approximately symmetrical about a horizontal plane through its midsection such that the two ribs are essentially identical.

The flexible carrier has a generally C shaped configuration in which the two open ends of the C define a small gap which can be substantially widened by elastic deformation of the carrier and these ends each have an arcuate surface which faces toward the interior of the C and has a low coefficient of sliding friction. This carrier also has a means for attachment to the curtain which it is adapted to suspend from the bendable track. In a preferred embodiment this is an integral aperture through the body of the carrier on the outside of the backbone of the C through which the top of a classical curtain or drapery hook can be passed. In a particularly preferred embodiment the gap between the open ends can be increased by at least about 100%, more preferably by, at least about 150% by elastic deformation of the carrier such that the open ends of the carrier can be passed over the lower rib of the bendable track and the then return to their original configuration. In a preferred embodiment the open ends have an approximately circular cross section.

The bendable track and multiple flexible carriers may be combined into an assembly that provides for the vertical suspension of a curtain such that the curtain can be moved by sliding in the horizontal direction with minimal noise. The open ends of the carrier ride on the horizontal ledge of the lower rib of the bendable track without the intervention of wheels or other mechanical roller devices. The small gap between the open ends of each carrier is greater than the thickness of the bendable track immediately above said horizontal ledge such that the open ends do not have to contact the vertical portion of the track. It is preferred that the friction between the open ends and the horizontal ledge of the lower rib is no more than that which would be observed if the open ends carried wheels which rode on this surface.

The bendable track may be conveniently suspended from a supporting structure such as a ceiling or other overhead structure by means of spring clips which capture the upper rib of the track. In a preferred embodiment the spring clips are configured such that the bendable track may be snapped into and out of engagement with the spring clips by a normal adult human without the use of tools. In a preferred embodiment a bendable track engaged by the spring clips may be moved in a horizontal direction to facilitate suspending the track from a supporting structure such as ceiling or other overhead structure. The spring clips carry means for affixing them to the supporting structure such as a hole in the top of the spring clip adapted for a screw or bolt passing through the hole. In a preferred embodiment the spring clips are attached by means of a screw to a clip designed to engage the tee-bar of a tile ceiling structure.

DETAILED DESCRIPTION OF THE INVENTION

Figure 2:
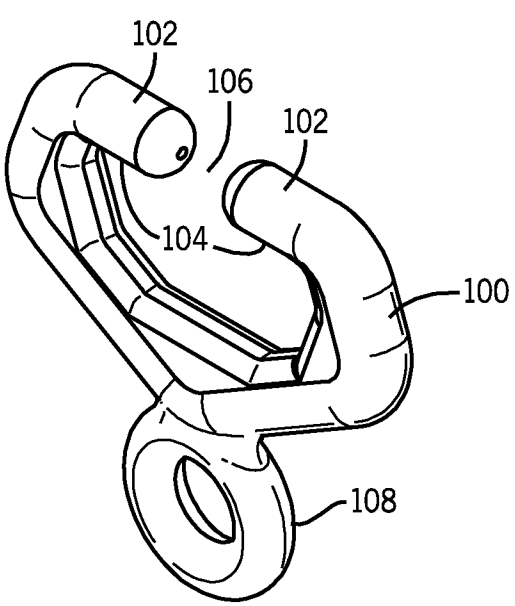
FIG. 2 is a perspective view of the flexible carrier.

The present invention facilitates the vertical suspension of a curtain, which is able to traverse in the horizontal direction over a non-linear path by pulling on the curtain, using a bendable track and flexible carriers, which can be snap fitted to the bendable track anywhere along its length and carry means for attachment to the curtain. The carriers ride along a horizontal ledge of the track without wheels or other roller devices and are able to traverse it under the load of a suspended curtain with a low degree of sliding friction, such that the curtain can easily be caused to traverse along the horizontal path of the track. In a preferred embodiment the bendable track is adapted to be affixed to a support structure such as a ceiling or other overhead structure by snap fitting into a plurality of supporting devices such as spring clips which have previously been secured to the support, structure.

The bendable track has the general appearance of a symmetrically shaped beam with a height greater than its width and ribs projecting in the horizontal direction at its top and bottom with the bottom rib having a horizontal ledge with a top surface which exhibits a low coefficient of sliding friction. It is convenient to have a lower rib with a width of between about 0.4 and 0.5 inches and a central section just above the rib with a width of about 0.05 and 0.2 inches. The track can be readily bent in the horizontal direction to take a permanent set of at least about 90° by a normal adult human without the aid of tools. In a preferred embodiment the width of the track beneath the horizontal ledge formed by the lower rib gradually decreases in width in proceeding vertically away from the main body of the track. More preferably the track has an arcuate surface beneath said horizontal ledge. This conveniently facilitates snap fitting the flexible carriers onto the track. With such a configuration the C shaped flexible carriers can simply be oriented with their gaps facing the bottom surface of the track and then pushed against the bottom of the track. The open ends of the flexible carriers can then ride along the lower surface of the track with the gap widening through elastic deformation of the carriers until they pass over the lower rib thus establishing the potential that a flexible carrier can be, snap, fitted to the track by a normal adult human using a single hand. In one preferred embodiment the track possesses one continuous curve extending from one outer edge of the lower rib to the other outer edge. Rut to facilitate single handed snap fitting it is just desirable that the track beneath said horizontal ledge have a sloped or curved surface at all widths greater than the gap between the open ends of an unstressed carrier. Thus it is possible that this bottom surface have sloping or curved profile which is truncated at a width less than or the same as the size of said gap.

In a preferred embodiment the width of the track above the upper rib gradually decreases in width in proceeding vertically away from the main body of the in a manner similar to that described for the lower rib. This will facilitate snap fitting the track into support devices affixed to the support structure such as a ceiling or other overhead structure from which the track is to be suspended. In a particularly preferred embodiment this upper surface has an arcurate profile. In a particularly preferred embodiment the profile, of the track allows it to be moved in the horizontal direction after being snap fitted to the support devices thus allowing for final adjustment of position of the track after it is suspended from the support structure.

In a preferred embodiment the bendable track is symmetrical about its vertical midpoint and has curved portions extending from the outer edges of both its upper and lower ribs and thus can be readily snap fitted into support devices while flexible carriers can be snap fitted to it. This embodiment provides a profile which allows the track to be moved in the horizontal direction after being snap fitted to the support devices. In a particularly preferred embodiment the curved portions are such that the flexible carriers can be snap fitted to the track by a normal adult human using a single hand. This symmetrical profile contributes measurably to the ease of use of the track as it can be installed without concern for identifying a top versus a bottom.

The bendable track preferably has sufficient flexibility that it can be formed into rolls using lengths of greater than about 100 feet. This not only provides convenience in manufacturing and shipping but more importantly it facilitates installations in which there are no junctions in the track. The typical curtain installation requires less than about 100 feet of track so that the installation can provide a continuous seamless run of track which is a real advantage in a suspended curtain having a smooth and unimpeded horizontal traverse. In this field junctions between adjacent sections of suspending track are rarely perfect and are frequently the cause of impairment in the smooth traverse of a suspended curtain hanging up the travel of the carriers by which the curtain is suspended.

It is convenient to fabricate the bendable track by extrusion as it typically has a uniform profile along its horizontal length. In a preferred embodiment the track is fabricated by extruding a material which readily confirms to the desired profiles, such as curved upper and lower edges, and exhibits a desirably coefficient of sliding friction, around a core of another material which displays desired plastic deformation properties. In a particularly preferred embodiment the core is a flat sheet of a ductile metal and the outside is thermoplastic polymer. In an especially preferred embodiment the central portion of the outside walls of bendable track between the upper and lower ribs are bowed away from the metal core to facilitate the insertion of screws into these outside walls. Thus it is made easier to secure the support devices to the bendable track after the bendable track has been adjusted to its final position for suspension of a curtain. In such a configuration it is advantageous to also provide the track with inside walls opposite the bowed section which adhere to the metal core.

The flexible carrier has the approximate configuration of the letter C in that it has two open ends which face it each other across a small gap, has an open space beneath the open ends which in cross section is considerably wider than this gap and has side and bottom walls which completely enclose the open space beneath the open ends. The profile of the flexible carrier is such that the two open ends can rest on the horizontal ledge of the lower rib of the bendable track without touching the vertical walls of the track and the open space can enclose the portion of the bendable track below this horizontal ledge without touching any portion of the bendable track. This typically requires that the open space be wider than the lower rib of the track and that the open space be deeper than the height of the bendable track below the horizontal ledge of the lower rib.

The flexible carrier should be configured such that the distance between the two open ends can be substantially increased by elastic deformation. This conveniently facilitates the snap fitting of the flexible carrier over the lower rib of the bendable track by allowing the gap between the open ends to be increased to pass over the lower rib while under stress and then, when the stress is relieved, closing to approximately its original dimension so as to ride on the horizontal ledge of the lower rib, of the bendable track. It is preferred that the gap be capable of being increased by at least about 100%, more preferably by at least about 150%. A convenient initial gap is between about 0.1 and 0.3 inches and a convenient expanded gap is between about 0.4 and 0.5 inches.

The outer ends of flexible carrier should have a surface which tends to minimize their friction with the surface of the horizontal ledge of the lower rib of the bendable track on which they are adapted to ride. One aspect is to minimize the contact areas with this surface. A convenient approach is to have the surface of an open end which will ride on the horizontal ledge, i.e., the surface which faces the open area, have an arcuate profile. It is particularly convenient for the open ends to have an approximately circular cross-section. Another aspect is to make the contact surface smooth and to construct it of a material with a low coefficient of sliding friction.

The flexible carrier should also carry a means for securing it to the curtain which is to be suspended from the bendable track. The means is preferably compatible with common means for attaching curtains to curtain rods. A typical such attachment means is a drapery or curtain hook which is commonly actually a double hook with a larger lower hook section adapted to connect to a grommet, loop or hole in the curtain and a smaller upper hook section adapted to connect to the suspending means used to hang the curtain vertically. A convenient securing means is a hole in the bottom of the carrier through which the smaller upper hook section can be passed. It is preferred that the carrier have material beneath the open space through which such a hole passes such that the open space is isolated from the securing means.

The flexible carrier may conveniently be made of a thermoplastic material and be fabricated by injection molding. It is preferred for ease of manufacture and cost to be a unitary article fabricated from a single material.

The bendable track and the flexible carriers are adapted to form an assembly which facilitates the vertical suspension of curtain and allows the curtain to readily traverse in the horizontal direction along the path of the track without the use of wheels or other roller devices. Among other advantages this allows the traverse to occur without the chattering normally observed when curtains are suspended on by small wheels. In such an assembly the flexible carriers ride on the horizontal ledge of the lower rib of the bendable track with a minimum of friction without otherwise contacting the bendable track. It is preferred that the friction be no more than if the curtain were suspended by wheels.

The bendable track is conveniently secured to a building structure, typically a ceiling or other overhead structure using securing devices into which the bendable track can be snap fitted. In a preferred embodiment the securing device is adapted to engage the upper rib of the bendable track. A preferred securing device is a spring clip in which the upper portion is wide enough to accommodate the upper rib of the bendable track and a lower portion is, in its relaxed configuration, smaller in width than the upper rib. The securing device will typically carry some means to facilitate its attachment to the ceiling or other overhead structure such a screw hole in its top surface. However, the securing devices may also be adapted to be secured to a wall bracket. It may optionally carry a means for facilitating attachment to the bendable track in addition to the snap fit such as screw holes in its side walls which contact the bendable track.

The design of the bendable track and the flexible carrier facilitates a particularly convenient installation procedure. A series of securing devices such as spring clips can be affixed to a ceiling or other overhead structure to define a desired path which need not be linear but may have a number of bends or curved sections. Then the bendable track may be cut from a roll to supply a sufficient length for the path. The track may be snap fitted into the securing devices and bent by hand between securing devices as needed to conform to the desired path. Adjustments can be made by sliding the bendable track through the securing devices. If desired the track can be secured against further sliding by placing screws into the track through screw holes in the side walls of the securing devices. The flexible carriers may now be affixed to the track by pressing their open ends against the curved profile of the bottom of the track causing them to expand and snap fit over the bottom rib. This may be done single handedly. Then a curtain may be secured to the flexible carriers which are now suspended from the bendable track using the securing means. For instance, hooks which engage the curtain may also engage a hole in the flexible carrier. Alternatively, the curtain may first be secured to the flexible carriers and then the carriers can be snap fitted to the bendable track.

The assembly of the bendable track and the flexible carriers finds particular utility in the creation of temporary private spaces though it is useful in any situation in which a vertically suspended curtain is to traverse a non-linear path. Thus the assembly is particularly useful the suspension of cubicle curtains common in hospital emergency rooms. But it is also useful for shower curtains, especially those which follow a circular or semi-circular path, theaters, hospitality areas such as hotel lobbies, sales display areas and curved windows.

The flexible carrier should be constructed of a material which provides both adequate strength in the ends which are adapted to ride on the horizontal ledge of the lower rib of the bendable track and adequate elastic deformation to allow said ends to fit over said rib and then ride on the horizontal ledge of said rib. It is convenient if the material is able to sustain a load of at least about 30 pounds, preferably about 40 pounds, most preferably about 50 pounds on a total cross-sectional area of about 0.04 square inches, i.e. with each end riding on the rib having a cross sectional area of about 0.02 square inches. In other words, that the material display a shear strength of at least about 750 psi, preferably at least about 1000 psi, most preferably at least about 1250 psi. It is also convenient if the carrier can elastically deform to as to increase the distance between its ends by at least about 0.15 inches, at least preferably about 0.20 inches, most preferably at least about 0.30 inches.

It is convenient that the flexible carrier be constructed of a polymeric material with the necessary strength and elasticity. It is preferred for reasons of cost and manufacturing ease that the material be injection moldable. Suitable polymers include nylon and polyacetal (also known as polymethylene oxide) homopolymers and copolymers and among these those with flexural strength greater than about 10,000 psi are particularly suitable. Nylon 6,6 is preferred and the copolymerization product of trioxane and dioxolane is particularly preferred. Commercial exemplars of such polymers are Vydyne® 21SPF/21SPG and CP Pryme Acetal AC109-9, respectively.

The surfaces of the flexible carrier which are adapted to ride on the horizontal ledge of the lower rib of the bendable track, i.e. the surfaces of the bottoms of the open ends which are adapted ride on this ledge, should have a low coefficient of sliding friction. This is conveniently achieved by constructing at least the ends of the carrier out of a material with such a coefficient such as nylon or polyacetal. It is preferred to add a lubricant to the polymeric matrix out of which the ends are fabricated to enhance the slidability of said surfaces. Injection moldable polymers which have a lubricating agent such as a polysiloxane distributed through them are preferred. A particularly suitable internally lubricated polymer is the copolymerization product of trioxane and dioxolane containing more than about 1 weight percent, preferably more than 5 weight percent, of a high molecular weight polysiloxane.

It is preferred that the flexible carrier display no more than and more preferably less sliding friction when traveling over said bendable track horizontal ledge under a vertical load than would be displayed by rollers such as nylon wheels carrying, the same load. It is particularly desirable that the force required to have a curtain suspended by said carriers traverse along said bendable track be no greater than the force required to cause the traverse of a curtain suspended by wheels along its supporting track.

The bendable track should be constructed of a material which has adequate strength to support a typical cubical curtain and withstand its being pulled to traverse but should also be capable of plastic deformation in the horizontal direction by a normal adult human without the use of tools. It is conveniently constructed of materials which can be fabricated in rolls of 100 feet or more and readily cut to length as required for particular installations. It is convenient to use a material which has a fairly low weight per unit length which thus facilitates its attachment to a ceiling. Among the suitable materials are the lighter metals of construction such as aluminum and the engineering polymers such as ABS and PVC, which have a flexural strength of about 10,000 psi or greater. It is preferred that the bendable track be constructed of materials which can be easily cut to length with a hand tool such as a hacksaw. For instance, a bendable track of a thermoplastic polymer such as ABS or PVC with an aluminum core is convenient.

It is preferred for reasons of cost and manufacturing ease to use a material that, can be fabricated by extrusion. It is particularly preferred to use aluminum, PVC or ABS with a flexural strength of about 10,000 psi or greater and it is especially preferred to use a composite of PVC or ABS with aluminum in which the polymer has been extruded over a core of aluminum. A particularly preferred aluminum for such a core is a 3105 alloy with between a H22 and H24 temper.

It is also preferred that the surface of horizontal ledge of the rib adapted to support the carrier be made of a material with a low coefficient of sliding friction. Preferred for this purpose are organic polymers. It is convenient to select a polymeric material which both has suitable strength and deformability characteristics for forming the main body of the bendable track and displays a suitable coefficient of sliding friction. This includes PVC and ABS.

The low coefficient of sliding friction desired for both the surface of the lower horizontal ledge of the bendable track and the open ends of the flexible carrier can be conveniently characterized as similar to that exhibited by a smooth surface of ABS or PVC in contact with a smooth surface of nylon or polyacetal. It is preferred that such coefficient have a value of lees than about 0.50 and more preferably less than about 0.30.

Figure 1:
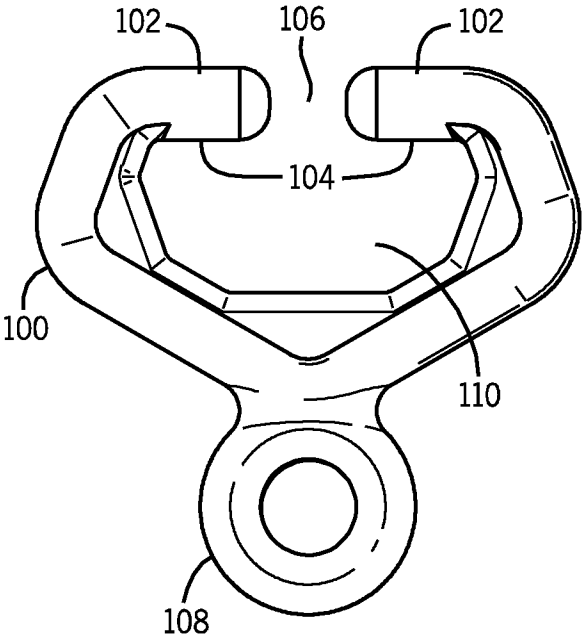
FIG. 1 is a side elevation of the flexible carrier adapted to interact with the bendable track and carry a curtain for traverse along the bendable track.

A flexible carrier made in accordance with the teachings of the present application and illustrating aspects of the present invention is shown in FIGS. 1 and 2. It was injection molded from a polyacetal which is the copolymerization product of trioxane and dioxolane having a flexural strength of 13,100 psi, commercially available as CP Prymc® Acetal AC100-9, to which has been added about 8 weight percent of a master batch of a polyacetal containing 40 weight percent of an ultra-high molecular weight polysiloxane polymer, which master batch is commercially available as Dow Corning MB40-006. The carrier 100 has a generally C shape with a height of 1.141 inches, a width of 1.133 inches and open ends 102 which have a diameter of 0.150 inches with each having a bottom surface 104. There is a gap between the open ends 106 of 0.160 inches which is expandable by elastic deformation to 0.450 inches. The carrier has an integral ring 108 with an internal diameter of 0.2 inches and an outside diameter of 0.450 inches, which is suitable for carrying a drapery or curtain hook. The carrier 100 has an open space 110 with a height of 0.318 inches and a width between about 0.71 and 0.32 inches.

Figure 3:
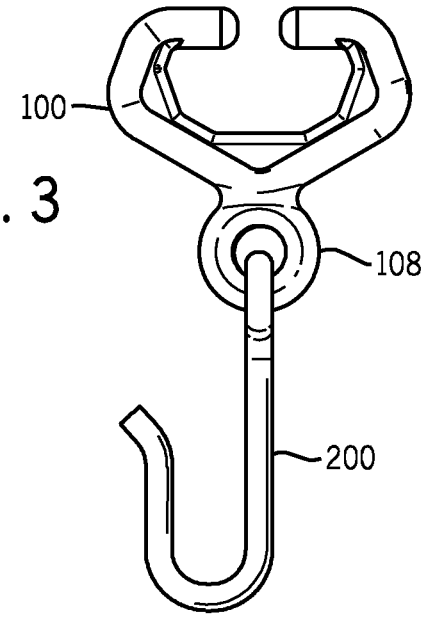
FIG. 3 is a side elevation of the flexible carrier carrying a hook which is used to connect the carrier to a curtain.

FIG. 3 illustrates the flexible carrier 100 with an aluminum hook with a height of 1.521 inches affixed via its ring 108.

Figure 4:
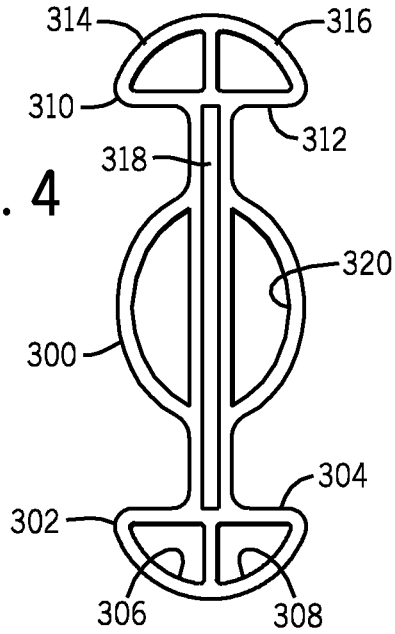
FIG. 4 is a cross section of the bendable track showing its structural features including those which are adapted to interact with the flexible carrier.
Figure 5:
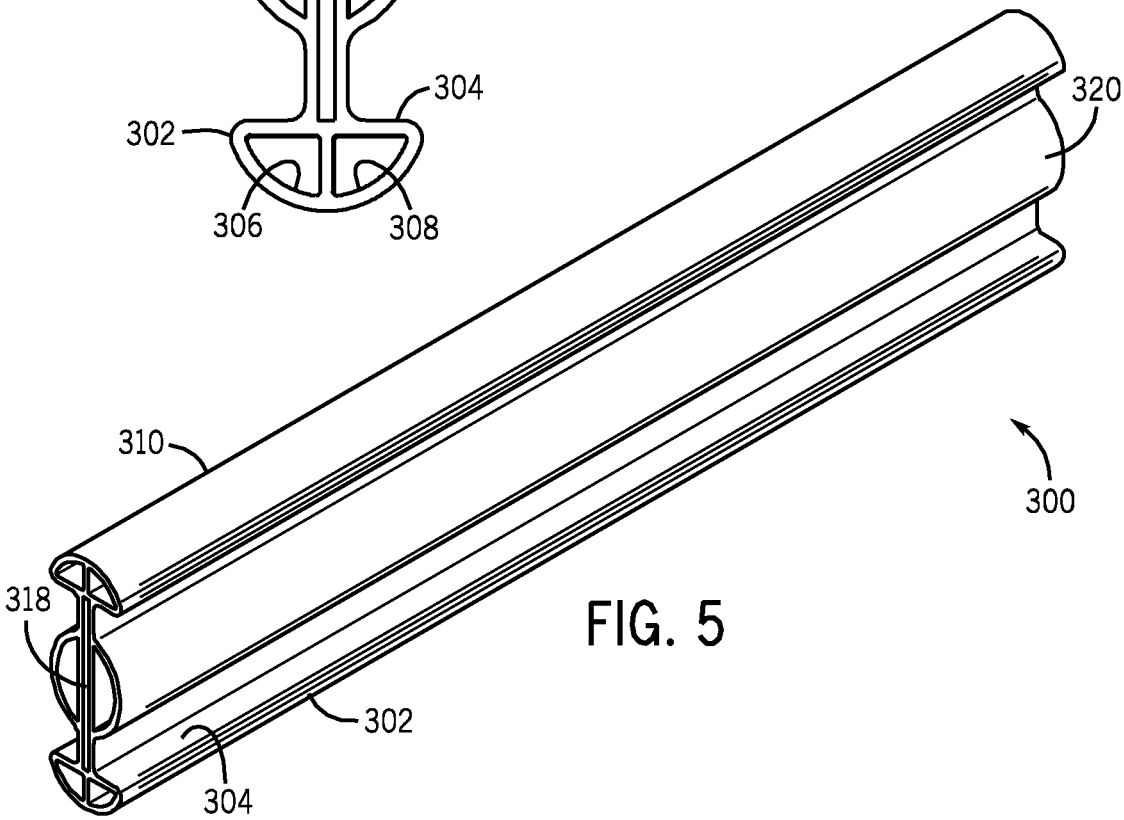
FIG. 5 is a perspective view of the bendable track.

A bendable track made in accordance with the teachings of the present application and illustrating aspects of the present invention is shown in FIGS. 4 and 5. It was made by extruding ABS with a flexural strength of 10,000 psi, commercially available as Polylac PA-717C, around a core of 3105 aluminum temper H22 to H24. The bendable track 300 has a height of 1.375 inches and a minimum width of 0.10 inches. It has upper and lower ribs 302 and 310 which each have a maximum width of 0.450 inches and a horizontal surface 304 and 312, respectively. All four curved surfaces 306, 308, 314 and 316 have a radius of 0.239 inches. The lower rib 302 has two curved surfaces 306 and 308 which join at the centerline of the track and the upper rib similarly has two such surfaces 314 and 316 which join at the centerline. The track 300 also has an aluminum core 318 and a bowed middle section 320.

Figures 6, 7:
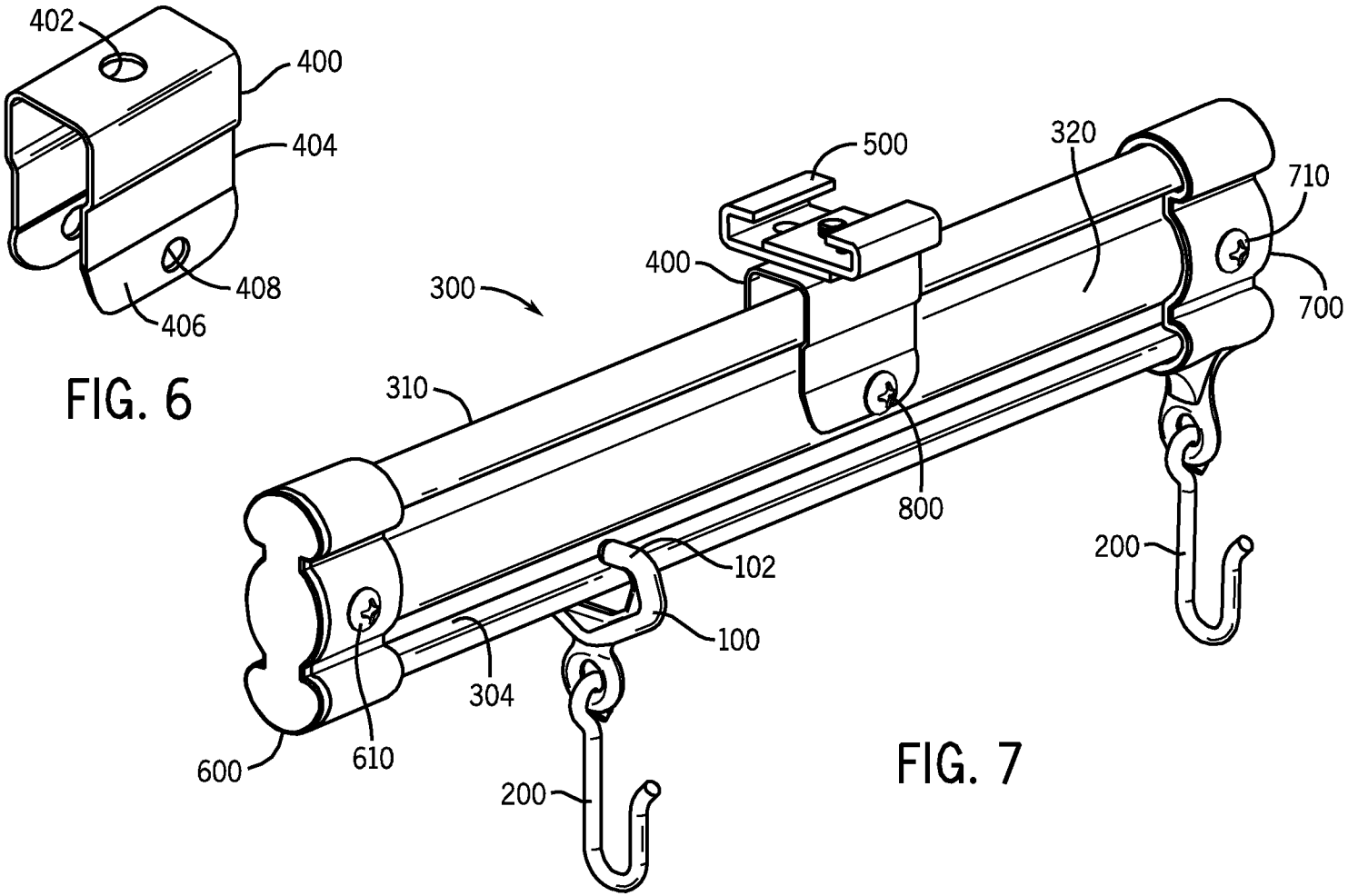
FIG. 6 is a perspective view of the spring clip which is adapted to affix the bendable carrier to a ceiling structure so that a curtain can be suspended from the bendable track via flexible carriers with hooks affixed to them.
FIG. 7 is a perspective view of an assembly of the bendable track affixed to the spring clip and having the flexible carrier which carries a hook affixed to it.

A securing device which may be used with the present invention is shown in FIG. 6. It is a spring clip 400 made of spring steel which has a screw hole 402 through which it can be affixed to a support structure such as a ceiling or other overhead structure or a wall bracket. It also has a detent 404 for capturing the upper rib 310 of the bendable track and a lower outward angled walls 406 adapted to mate with the bowed middle section 320 of the bendable track 300. These walls carry screw holes 408 through which screws can be run into the bowed middle section 302 securing the bendable track 300 from horizontal movement.

FIG. 7 illustrates a complete assembly with the spring clip 400 secured to both the bowed middle section 320 using screw 800 and to a ceiling grid clip 500 adapted to capture the tee-bar of a tile ceiling in a conventional manner and, with end caps 600 and 700 affixed to the ends of the bendable track 300 with screws 610 and 710, respectively. The end cap 600 has a screw hole 620 which can accommodate a screw with which to affix the end of the bendable track 300 to a wall or other vertical supporting structure. The end cap 700 carries a hook 200 which is suspended at the same height as the hook 200 affixed to the flexible carrier 100.

EXAMPLE

A complete assembly or 21 flexible carriers made in accordance with FIGS. 1 and 2 carrying a hook in accordance with FIG. 3 and a bendable track made in accordance with FIGS. 4 and 5 was created in accordance with FIG. 7 and suspended from a tile ceiling using the spring clip of FIG. 6 carrying means to engage the Tee-bar of a tile ceiling. A polyester fabric curtain 98 inches tall and 116 inches wide with an 18 inch mesh top carrying 21 grommets spaced 6 inches apart and weighing 4.75 pounds was suspended from the flexible carriers. Then the curtain was made to traverse the length of the bendable track by pulling upon it and the noise of traverse was noted.

The same curtain was attached to 21 carriers which used nylon wheels to ride on the lower flange of a vinyl I-beam with a steel core which was itself suspended from a ceiling and the curtain was made to traverse the length of the bendable track by pulling upon it. The noise of traverse was noted to be significantly greater than was observed with the combination of the flexible carrier and bendable track of present invention in the test discussed hereinabove.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An assemblage adapted for the vertical suspension of a curtain from a supporting structure such that the curtain can be moved by sliding in the horizontal direction comprising a bendable track and multiple roller free flexible carriers which are adapted to suspend said curtain from said track, a) said track having its greatest dimension along its vertical axis and having two spaced apart generally vertical walls and having adjacent to its top and bottom a generally horizontal upper and lower rib, respectively, which projects from both of said walls, the lower rib defining an essentially horizontal ledge which extends outward from both of said walls and has a top surface with a low coefficient of sliding friction, said track having a sufficiently narrow horizontal thickness and being constructed of sufficiently ductile materials that it is capable of being bent in the horizontal direction at least 90° resulting in plastic deformation without fracture by a normal adult human without the use of tools but being substantially more resistant to bending in the vertical direction; and b) said carriers each comprising a generally C shaped body with means for attachment to said curtain, two ends of the C being spaced apart to create a small gap which is greater than the distance between the two vertical walls of said track but is substantially smaller than the distance between outer edges of the lower rib, which gap can be increased in size by elastic deformation to greater than said distance between the outer edges of the lower rib such that said carriers can be mounted on said horizontal ledge by such expansion and release of said expansion, each of said ends having an arcuate surface with a low coefficient of sliding friction which faces to an interior of the C and is adapted to rest on said horizontal ledge;

said assembly being designed such that when said carriers are suspended from said horizontal ledge of said track by the ends of their C's they are capable of supporting said curtain attached to them and they are able to readily slide along said horizontal ledge while supporting said curtain.

2. The assemblage of claim 1 wherein the support structure is a ceiling or other overhead structure.

3. The assemblage of claim 1 also including supporting devices comprising means for attachment to said supporting structure and means for releasably and slidably attaching to the upper horizontal rib of said track not interacting with said carriers such that said track can be slid in the horizontal direction when engaged by said supporting devices and can be engaged by and released from said supporting devices by a normal adult human without tools by exerting a sufficient appropriately directed force on said track.

4. The assemblage of claim 3 wherein said supporting devices are a plurality of spring clips.

5. The assemblage of claim 4 wherein the spring clips are adapted to engage tee-bars of a tile ceiling.

6. A bendable track adapted to support the vertical suspension of a curtain and provide for the sliding movement of said curtain in the horizontal direction said track having its greatest dimension along its vertical axis and having two spaced apart generally vertical walls and having adjacent to its top and bottom a generally horizontal upper and lower rib, respectively, which projects from both of said walls, the lower rib defining an essentially horizontal ledge which extends outward from both of said walls and has a top surface with a low coefficient of sliding friction, said track having a sufficiently narrow horizontal thickness and being constructed of sufficiently ductile materials that it is capable of being bent in the horizontal direction at least 90° resulting in plastic deformation without fracture by a normal adult human without the use of tools but being substantially more resistant to bending in the vertical direction.

7. The bendable track of claim 6 wherein the ductile material of which the top surface of said horizontal ledge is constructed exhibits less sliding friction with common organic polymers than a smooth surface of aluminum would exhibit.

8. The bendable track of claim 7 wherein the width of the track beneath the horizontal ledge formed by the lower rib gradually decreases in width in proceeding vertically away from the main body of the track.

9. The bendable track of claim 8 wherein the portion of the track beneath the said horizontal ledge has a generally arcuate profile.

10. The bendable track of claim 9 wherein said profile is approximately semi-circular.

11. The bendable track of claim 6 wherein the upper rib defines an essentially horizontal ledge projecting from both of said vertical walls and the width of the track beyond said ledge of said upper rib gradually decreases in width in proceeding vertically away from the main body of the track.

12. The bendable track of claim 11 wherein the profile of the portion extending beyond both of said horizontal ledges is arcuate.

13. The bendable track of claim 6 wherein said track is symmetrical about its vertical midpoint.

14. The bendable track of claim 6 wherein the ductile material of which said track is constructed has a vertical core of a ductile metal and an outer body of an organic polymer.

* * * * *